US005687749A

United States Patent [19]

Brauer, Jr.

[11] Patent Number: 5,687,749

[45] Date of Patent: Nov. 18, 1997

[54] HUMIDOR

[76] Inventor: Walter H. Brauer, Jr., 160 Beech St., Roslindale, Mass. 02131

[21] Appl. No.: 493,653

[22] Filed: Jun. 22, 1995

[51] Int. Cl.[6] ..... A24F 13/00

[52] U.S. Cl. ..... 131/329; 131/328; 312/31

[58] Field of Search ..... 131/328, 329, 131/290; 473/345, 245, 246; 312/31

[56] References Cited

U.S. PATENT DOCUMENTS

| | | | |
|---|---|---|---|
| 1,984,984 | 10/1934 | Perry | 131/300 |
| 2,333,049 | 10/1943 | Shapiro | 131/300 |
| 5,395,109 | 3/1995 | Fenton, Jr. | 473/345 |

*Primary Examiner*—Vincent Millin
*Assistant Examiner*—Charles W. Anderson
*Attorney, Agent, or Firm*—Weingarten, Schurgin, Gagnebin & Hayes LLP

[57] ABSTRACT

A humidor for more than one tobacco product, such as a cigar, includes a storage portion defining a tobacco storage area for storing the cigars end-to-end and a sealing portion for sealing the cigars within the storage portion. The sealing portion can include a liquid reservoir for moistening a wick to keep the cigars moist. The humidor can be configured as a golf club, wherein the shaft of the club corresponds to the storage portion and the head of the club corresponds to the sealing portion.

12 Claims, 1 Drawing Sheet

HUMIDOR

FIELD OF THE INVENTION

The present invention relates to a humidor, and more particularly to a reservoir for storing and dispensing tobacco products.

BACKGROUND OF THE INVENTION

Loose tobacco, as well as rolled tobacco products, such as cigarettes, cigarillos, and cigars are commonly stored in air-tight, resealable containers to maintain the freshness of tobacco. More particularly, tobacco stored in a sealed container does not dry out. For example, cigars are frequently stored in bulk, side by side, in a rectangular box having a lid with a good seal. Individual cigars are often stored in a cylinder which is slightly larger than the cigar and which includes a screw-on top for providing a good seal.

SUMMARY OF THE INVENTION

A humidor is provided to carry and store more than one tobacco product, such as a cigar, in a convenient and concealable manner. The humidor includes a storage portion defining a tobacco storage area for storing the cigars end-to-end and a sealing portion for sealing the cigars within the storage portion. The sealing portion can include a liquid reservoir for moistening a wick to keep the cigars moist.

BRIEF DESCRIPTION OF THE DRAWINGS

These and further features of the invention will be better understood with reference to the accompanying specification and the drawings which.

DETAILED DESCRIPTION OF THE INVENTION

Figure 1:
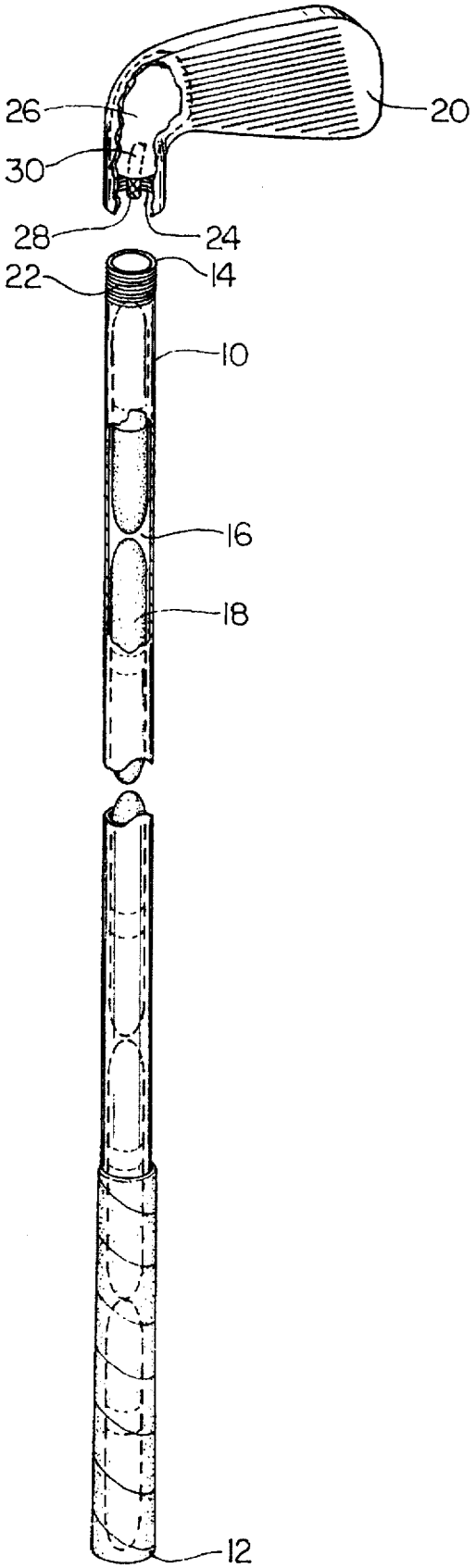
FIG. 1 is a cut-away perspective view of a humidor in accordance with the invention.

FIG. 1 is a cut-away drawing of a humidor for storing and dispensing rod-like, or rolled tobacco products, such as cigarettes, cigarillos, and cigars, hereinafter referred to as tobacco products.

The humidor includes a tobacco product storage portion 10 that is closed at a first end 12 and open at a second end 14. The open second end 14 provides access to a hollow region in the storage portion 10 that defines a tobacco product storage area. In the embodiment of FIG. 1, the tobacco product storage area is configured as a substantially cylindrical tube or channel 16. The channel 16 has a diameter that is slightly larger than the diameter of a selected tobacco product 18 so that the tobacco product is easily inserted into and removed from the channel 16 through the open second end 16 in a lengthwise manner. The channel 16 has a length sufficient to receive more than one tobacco product 18 completely within the storage portion, wherein each of the tobacco products are laid end-to-end in a linear fashion. The number of tobacco products that can be stored within the humidor is determined by the length of the channel 16 and the length of the selected tobacco product 18.

The humidor includes a sealing portion 20 which is adapted to close or seal the open second end 14 of the storage portion 10. In the illustrated embodiment, closure and sealing are effected by mating the storage portion 10 with male threads 22 proximate the second end 14 of the storage portion with female threads 24 on the sealing portion 20. Of course the male and female threads can be reversed so that the female threads are on the storage portion 10 and the male threads are on the sealing portion 20. Additionally, other sealing techniques known to those skilled in the art, such as press fit, are compatible with the invention. After one or more tobacco products 18 have been introduced through the open end of the storage portion 10, and the sealing portion 20 has been affixed thereto, a stable environment is provided for the tobacco products.

Another feature of the invention provides for humidification of the tobacco product storage area. The sealing portion 20 can include a reservoir 26 for containing a fluid. A wick 28 having a first end 30 exposed to the fluid and a second end 32 exposed to the channel 16 allows a controlled amount of moisture from the reservoir 26 to be introduced within the channel 16 in a vapor state.

The storage portion 10 and sealing portion 20 can be configured as desired to facilitate carriage and storage of the humidor and to provide convenient accessibility of the tobacco product 18. For example, the humidor can be configured as a walking stick or cane, thereby providing not only the useful function of a cane but also providing storage for numerous cigars which might otherwise be too cumbersome to carry.

In the embodiment of FIG. 1, the humidor is configured as a golf club, wherein the storage portion 10 corresponds to a golf club shaft and the sealing portion 20 corresponds to a club head, in this case an iron. Although the club head can be made of plastic, a metal, molded head allows the club to more closely resemble other clubs normally carried in a golf bag. In this embodiment, the shaft or sealing portion 20 is a 36 inch plexiglass tube having an outer diameter between ¾ and ⅞ inches and an inner diameter that defines the channel 16 of ¾ to ⅝ inches. Ornamentation of the shaft can be provided as desired.

Although the invention has been shown and described with respect to exemplary embodiments thereof, various other changes, omissions and additions in form and detail thereof may be made therein without departing from the spirit and scope of the invention.

What is claimed is:

1. A humidor for a plurality of tobacco products, said humidor configured as a golf club, comprising:

a storage portion defining a tobacco storage area for storing said plurality of tobacco products end-to-end, wherein the shape of said storage portion corresponds to a club shaft; and a sealing portion for sealing said tobacco products within said storage portion, wherein the shape of said sealing portion corresponds to a club head.

2. The humidor of claim 1, wherein said sealing portion includes a liquid reservoir and a wick in communication with said liquid reservoir.

3. The humidor of claim 2, wherein said sealing portion and said storage portion are provided with threads for engaging the storage portion with the sealing portion.

4. The humidor of claim 1, wherein said humidor is configured as a walking stick or cane.

5. The humidor of claim 1, wherein said tobacco products are selected from the group consisting of cigarettes; cigarillos; cigars; and combinations thereof.

6. The humidor of claim 1, wherein said tobacco products are cigars or cigarillos.

7. The humidor of claim 1, wherein said sealing portion is adapted to seal or close said storage portion via press fit.

8. A humidor configured as a golf club for a plurality of tobacco products comprising:

a storage portion, the shape of which corresponds to a club shaft, defining a tobacco storage area for storing said plurality of tobacco products end-to-end, said tobacco storage area including a substantially cylindrical channel closed at a first end and open at a second end, and said substantially cylindrical channel having a length that is more than twice that of an individual one of said plurality of tobacco products; and a sealing portion, the shape of which corresponds to a club head, for closing said second end of said substantially cylindrical channel to seal said tobacco products within said storage portion, said sealing portion including a reservoir and a wick in communication with said reservoir.

9. The humidor of claim 8, wherein said cylindrical channel has a length greater than 30 inches and a diameter in the range of ¾ to ⅝ inches; and said storage portion is substantially cylindrical and has an outer diameter in the range of ¾ to ⅞ inches.

10. The humidor of claim 8, wherein said tobacco products are selected from the group consisting of cigarettes; cigarillos; cigars; and combinations thereof.

11. The humidor of claim 8, wherein said tobacco products are cigars or cigarillos.

12. The humidor of claim 8, wherein said sealing portion is adapted to seal or close said storage portion via press fit.

* * * * *